United States Patent [19]

Jackson

[11] 3,968,577

[45] July 13, 1976

[54] METHOD AND CONSTRUCTION OF FOOTWEAR INCORPORATING A CUSTOMIZED, FORM FITTED CASTING UNIT

[76] Inventor: Lynn Wolstenholme Jackson, 911 30th St., Santa Cruz, Calif. 95062

[22] Filed: Nov. 18, 1974

[21] Appl. No.: 524,619

[52] U.S. Cl. ..... 36/43; 36/28; 36/11.5

[51] Int. Cl.[2] ..... A43B 13/38; A43B 13/18; A43B 3/12

[58] Field of Search ..... 36/43, 28, 29, 30 A, 36/25 R, 71, 35 R, 35 B, 2.5 R, 2.5 AL; 30/30 R

[56] References Cited

UNITED STATES PATENTS

| | | | |
|---|---|---|---|
| 3,237,319 | 3/1966 | Hanson | 36/71 |
| 3,266,178 | 8/1966 | Gilkerson | 36/71 |
| 3,407,406 | 10/1968 | Werner et al. | 36/71 |
| 3,641,688 | 2/1972 | Von den Benken | 36/43 |

*Primary Examiner*—Patrick D. Lawson
*Attorney, Agent, or Firm*—Owen, Wickersham & Erickson

[57] ABSTRACT

A casting unit in the sole of footwear is custom shaped to the foot of the user. The casting unit comprises a layer of a formable material, the upper surface of which is shaped to the contour of the foot by stepping down on the casting unit. This applies the weight of the user to the casting unit and displaces the formable material to form an impression which is an exact inverse of the foot and which therefore conforms with the contour of the foot.

The edges of the layer are held in a fixed lateral position to cause the material to turn upward along the periphery of the foot. The resulting side and heel and toe containment provides, in combination with the foot sole impression, a positive foot-to-ground response and prevents rotation and slippage of the footwear from the foot.

In one form of the invention the material is cured to a permanently molded form after it has been shaped to the contour of the wearer's foot.

The formable material of the casting unit is either incorporated in the footwear as a prepackaged item or injected into the casting unit at the time of sale.

2 Claims, 8 Drawing Figures

METHOD AND CONSTRUCTION OF FOOTWEAR INCORPORATING A CUSTOMIZED, FORM FITTED CASTING UNIT

BACKGROUND OF THE INVENTION

This invention relates to methods and construction of a castable unit of footwear. It relates particularly to a method of making a customized, form-fitted footwear casting unit for engagement with and support of the undersurface of a person's foot in the footwear.

Current footwear has little to do with the inherent natural characteristics of the human foot in a comfortable and natural state. The flat, hard, innersoles of most of today's footwear only accentuate the concrete and pavement society in which we live and work. The usual footwear forces the foot into rigid and unnatural positions which cause discomfort to the wearer and which also can cause deformities to the feet.

It is well recognized that if the shoe fits the foot well, then it will be more comfortable to wear. And the comfort of one's feet has a great deal of effect upon one's emotional and physical states.

A large number of different techniques have been tried to improve the fit of a shoe. Resilient inner soles and inserts which provide support for the arches are often used to relieve some of the discomfort resulting from the flat, hard inner soles. Precontoured innersoles, such as preshaped wooden sandals, have also been used. And attempts have been made to provide a more customized fit by the use of molds. See for example, U.S. Pat. No. 2,742,717 issued Apr. 24, 1956 to Allen E. Murray which describes a method of hand forming a felt platform to a person's foot.

Athletic footwear presents its own special problems. In ski boots, for example, it is quite desirable to obtain a foot to boot fit that minimizes lost motion or slack between the foot and the ski. U.S. Pat. No. 3,581,412 issued June 1, 1971 to Melvin W. Dalebout discloses a technique of snuggly fitting a ski boot to the foot while cushioning the foot from the relative hard and rigid outer shell of the boot. In this patent an inner liner or boot is positioned within an outer shell with a cavity surrounding the inner boot. The user slips his foot in the inner liner and a liquid resin elastomer reaction mixture is then injected into the cavity and entirely around the bottom, sides and top of the foot and lower ankle. This reaction mixture is then permitted to set up to provide a snug fit about the entire foot and lower ankle of the person wearing the boot. Since the primary purpose in the U.S. Pat. No. 3,581,412 patent is to provide a snug fitting ski boot for stabilizing the position of the foot with respect to the ski, rather than providing a customized fit and support of the underside of the foot, no attempt is made to custom shape the innersole surface by stepping down on the boot to apply the person' s weight to the foot within the boot while the reaction mixture is setting up. Instead, as pointed out at column 4, lines 16 through 24 of this patent, an enlarged toe area is obtained by using an appropriately sized covering over the toes before the individual's foot is placed in the boot to thereby provide an enlarged compartment for the toes.

The prior art therefore has not provided a practical method or construction for obtaining a completely customized fit between the innersole and the foot in footwear.

It is a primary object of the present invention to overcome this deficiency of the prior art. It is a closely related object to provide a customized fit of the sole in footwear of the kind used for ordinary every day use.

SUMMARY OF THE INVENTION

The present invention provides the relatively natural comfort of a soil/sand fit to one's foot in all forms of footwear.

When standing in sand, the foot makes a natural impression, and the total contact between the foot and the sand takes place. This is the most natural and healthy state available to the foot.

The present invention provides for the construction of footwear incorporating a casting unit that allows the formation of the individual's footprint in the footwear as in the sand. In certain forms of the invention the footprint, after it is initially formed, becomes permanent in the footwear.

The present invention also provides the ability to custom fit the shoe to the foot in a manufactured, mass-produced shoe and at costs which are feasible from a marketing standpoint.

The present invention provides shoes which do in fact preserve the natural conformation and characteristics for the particular feet for which shoes are cast.

The present invention also allows the feet in an active state to retain a more stable position within the shoe. This prevents irritation due to friction. It also allows a greater degree of response between the ground and the shoe due to a more stable and exact transfer of movement of energy between the foot and the shoe. The custom fit provided by the present invention tends to prevent rotation and slippage of the footwear from the foot. This position function greatly benefits every day movement in terms of safety and it enhances the ability of the athlete.

Molding the inner sole into intimate contact with the inner surface of the foot minimizes the presence of air spaces. In cold climates the combination of this close contouring with certain particular materials for the casting unit provides a warmer shoe by minimizing the conductance of heat from the foot.

The casting unit has its edges contained in a way to cause a cupping of the sides of the feet. Toe and heel containment can also be provided, as desired.

In a particular embodiment of the present invention a room-temperature vulcanizing (RTV) silicone material is placed within a fully enclosed casting unit formed between the innersole and the subsole of a shoe while the material is in an uncured condition. The person who will use the shoe puts his foot within the shoe and shapes the upper surface of the inner sole and the silicone material within the casting unit to the contour of his foot by stepping down on this layer of silicone material to apply his weight to the casting unit. This displaces the material to the exact contour of the underside of the foot and also causes the relatively flexible inner sole to move into intimate engagement with the under surface of the foot. The RTV silicone material is then cured to a permanent molded state to thereby retain this custom fit.

Footwear apparatus and methods which incorporate the structure and techniques described above and which are effective to function as described above constitute specific objects of this invention.

Other and further objects of the present invention will be apparent from the following description and claims and are illustrated in the accompanying drawings which, by way of illustration, show preferred embodiments of the present invention and the principles thereof and what are now considered to be the best modes contemplated for applying these principles. Other embodiments of the invention embodying the same or equivalent principles may be used and structural changes may be made as desired by those skilled in the art without departing from the present invention and the purview of the appended claims.

DESCRIPTION OF THE PREFERRED EMBODIMENTS

Figure 1:
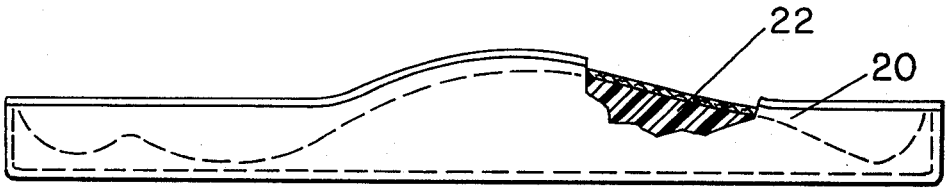
FIG. 1 is a side elevation view of a basic casting unit constructed in accordance with one embodiment of the present invention. The casting unit shown in FIG. 1 can be incorporated in a shoe as shown in FIGS. 2 and 3, a sandal as shown in FIGS. 4 – 7, or in other articles of footwear such as boots, etc.

A casting unit constructed in accordance with one embodiment of the present invention is indicated generally by the reference numeral 20 in FIG. 1.

The casting unit 20 is also shown in FIGS. 2, 4, 5, 7 and 8.

In its most basic form the casting unit 20 comprises a layer of formable material 22 which in one specific embodiment of the present invention is a room temperature vulcanizing (RTV) silicone rubber mixture having a curing agent which reacts to water vapor. A product that has been found quite satisfactory is one sold by the General Electric Co. as their product RTV 108.

Figure 4:
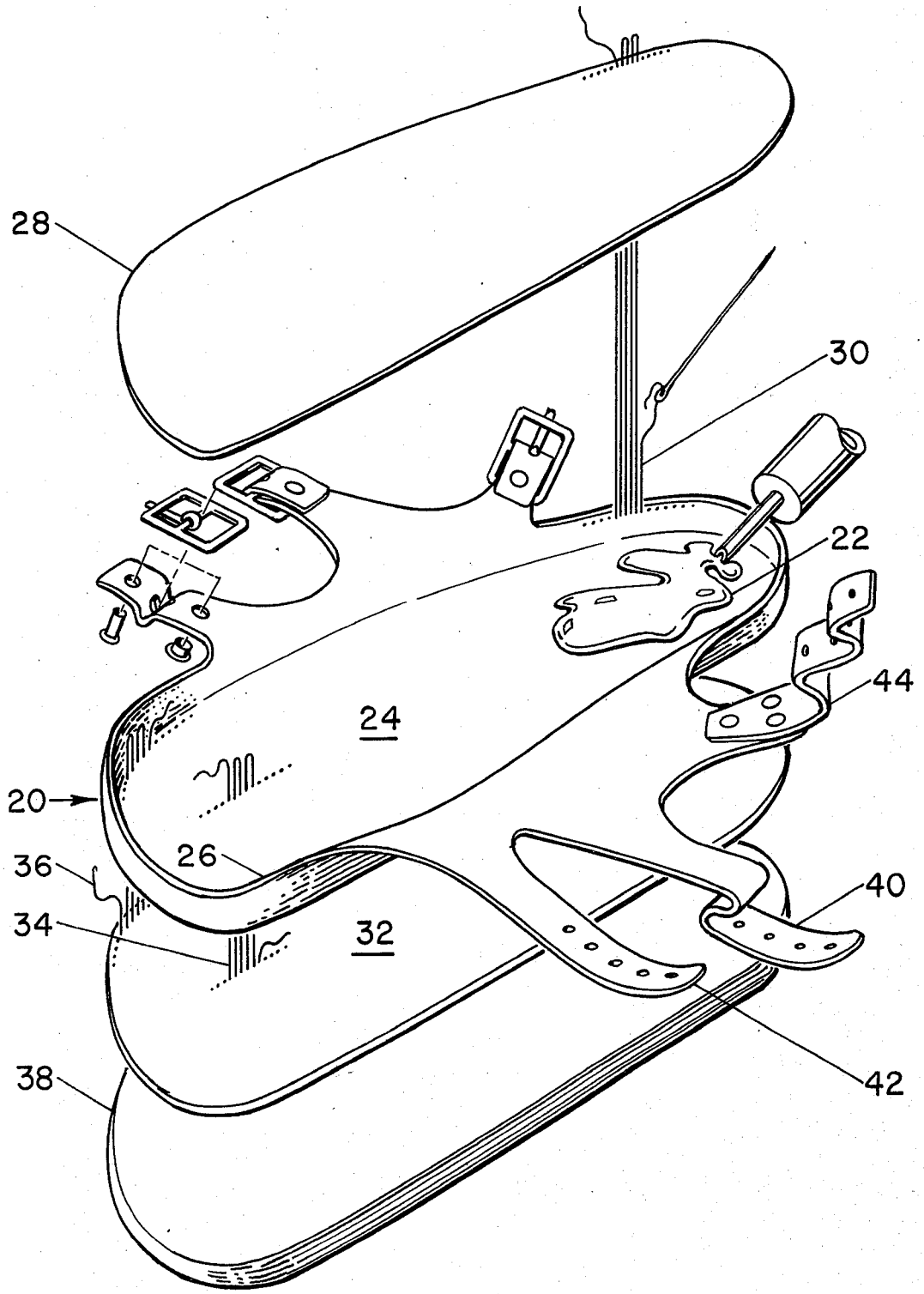
FIG. 4 is an exploded isometric view showing details of construction of a sandal incorporating the casting unit shown in FIG. 1.

As illustrated in FIG. 4 a layer of this formable material 22 is positioned on a support surface (which in FIG. 4 is a subsole 24 having an upturned edge 26 for retaining the peripheral edges of the layer in fixed position).

This particular silicone material is quite moldable, and it also provides a resilient adhesive sealing agent. With this particular silicone material it is therefore necessary to use an inner sole 28 on top of the layer of formable material 22 to prevent the moldable material 22 from sticking to the foot as the initial impression is made on the uncured material.

As illustrated in FIG. 4 the sole liner of innersole 28 is preferably stitched, by stitching 30, to the upturned peripheral edge 26 of the subsole; and in this case the casting unit 20 is a totally enclosed casting unit.

As illustrated in FIG. 4 this casting unit 20 is incorporated as an integral part of the sandal by stitching the subsole 24 to an additional subsole 32, as by stitching 34 and 36, and then fastening the subsole 32 to an outer sole 38 by gluing or any other conventional means.

Fastening straps 40, 42 and 44 may be included as an integral part of the subsole 24 of the casting unit 20.

Figure 5:
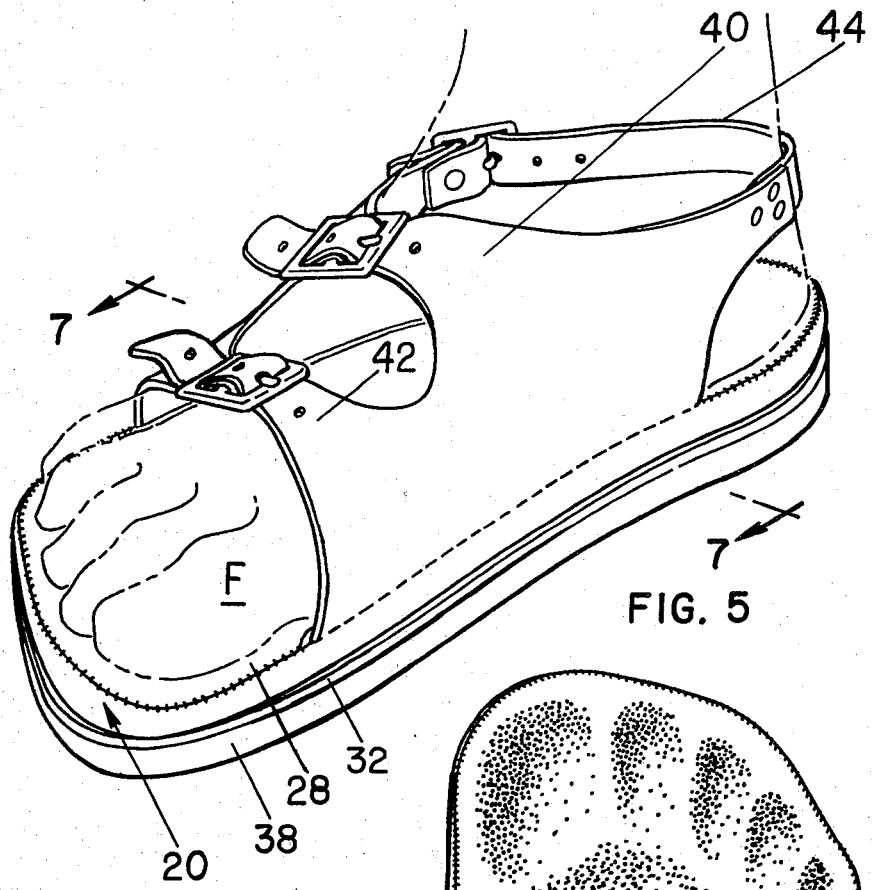
FIG. 5 is an isometric view of the sandal shown in FIG. 4 and illustrates how the wearer steps down on the casting unit to custom shape the casting unit to the user's foot.
Figure 6:
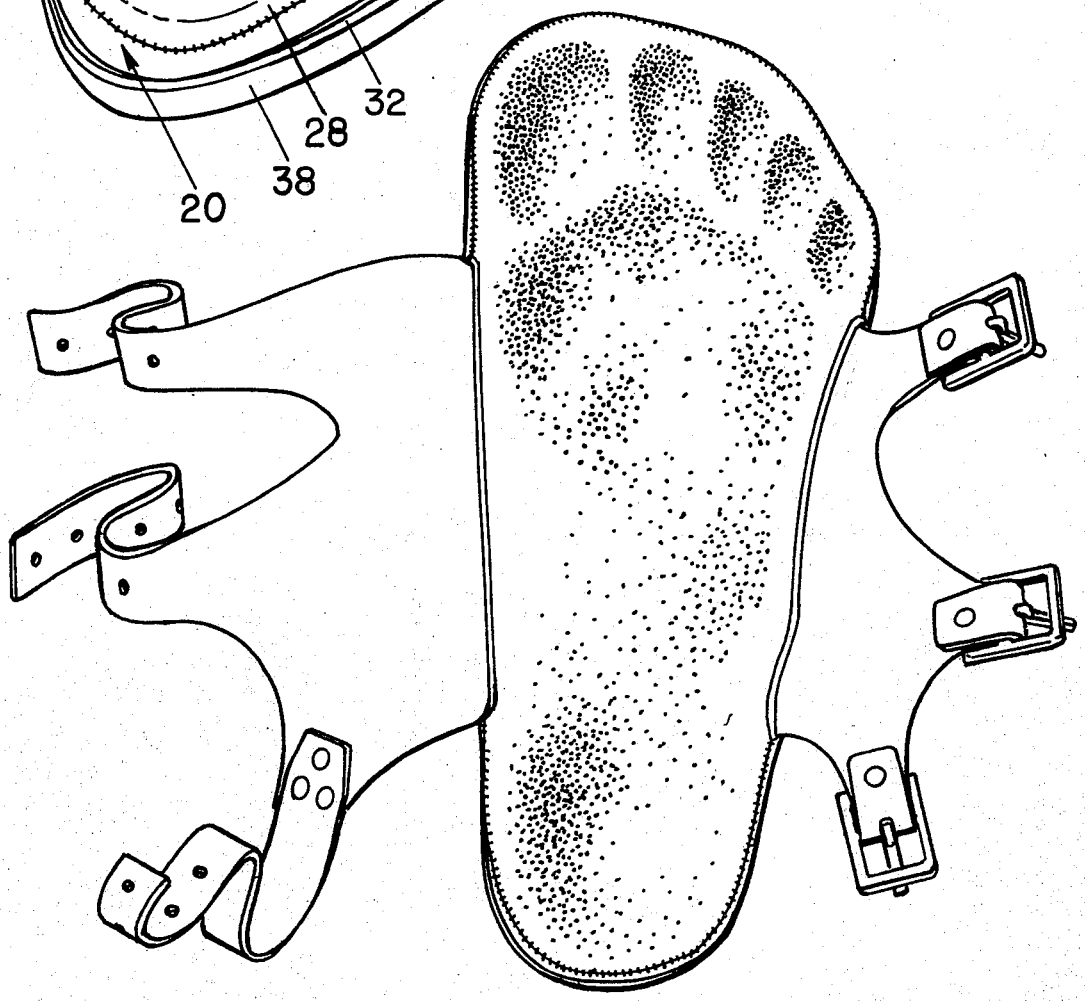
FIG. 6 is a top plan view of the sandal shown in FIGS. 4 and 5 and illustrates how the casting unit provides an exact fit to the user's foot with depressions for the toes, the ball of the foot and the heel and upwardly contoured areas for the longitudinal arch, the metatarsal arch and the space between the toes and the edge of the sandal around the periphery of the foot.
Figure 7:
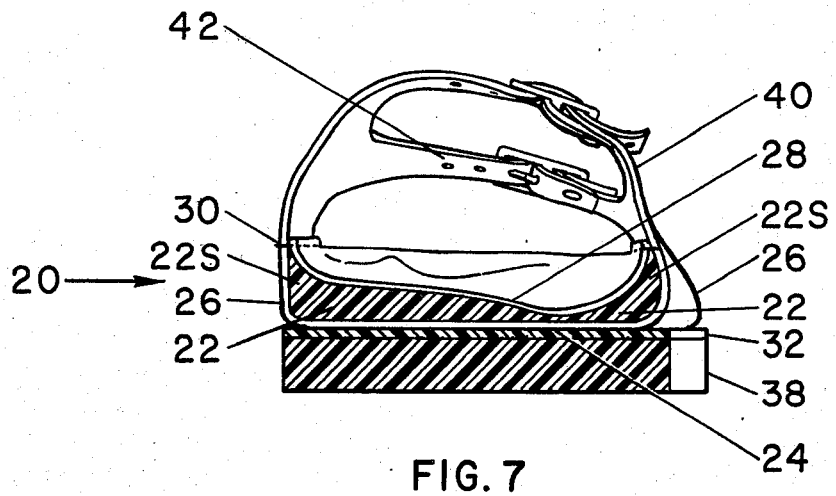
FIG. 7 is an end elevation view taken along the line and in the direction indicated by the arrows 7—7 in FIG. 5 and illustrates further how the casting unit conforms exactly to the arch configuration of the user's foot.

As best illustrated in FIGS. 5 and 7, the person who will wear the sandal then places his foot F in the sandal (as indicated in the phantom in FIG. 5). He then steps down on the casting unit 20 to apply his body weight to the casting unit. This causes the layer of formable material 22 to be displaced beneath the innersole 28 to make this layer of material and the innersole conform to the exact contour of the person's foot. As illustrated in FIG. 6, the innersole 28 thus is formed with depressions for the heel, the ball of the foot, and the individual toes as illustrated; and the formable material 22 flows upward into the plantar or longitudinal arch and the metatarsal arch. The material also flows upward into the spaces between the toes, and it cups upward around the entire outer periphery of the foot to provide cupping on each side of the foot and also toe and heel containment. This side containment or cupping is indicated at 22S in FIG. 7, and the toe containment is indicated at 22T in FIGS. 2 and 3. The heel containment is indicated at 22H in FIG. 2.

The shaping of the formable material 22 to the exact contour of the person's foot is therefore obtained by the direct action of placing the person's weight on the foot. The impression thus formed in the sole of the article of footwear provides a maximum of positive response between the foot and the ground. This natural conformation of the sole part of the article of footwear allows the feet in an active state to retain a more stable position within the shoe and prevents irritation due to friction. It also permits a more stable and exact transfer of movement and energy between the foot and the shoe. It greatly benefits every day movement in terms of safety, and it enhances the ability of the athlete.

The forming of the layer 22 and the inner sole 28 to the exact inverse of the underside of the foot also provides a containment which prevents the footwear from rotating or slipping from the foot. The forward nonslip response is enhanced by the natural appearance of the metatarsal arch in the inner sole, and also the natural appearance of the plantar arch. The lateral rotation is reduced by the formation of the plantar arch and the side cup retainments 22S.

In a preferred form of the present invention the formable material 22 is catalized after the initial shaping to retain this material in that shaped configuration. With the particular silicone mixture described above, this curing to a permanent molded state is accomplished by catalization by temperature. Depending upon the particular material used, the molding to a permanent state may be accomplished by placing the footwear in an oven and heating it for a period of time, such as two to three hours, or the curing may be accomplished at room temperature. Once the formable material 22 has been cured to a permanent molded state, it will retain that configuration, but it still exhibits sufficient resiliency to permit the flexing required in normal use of the footwear.

Cork particles may also be incorporated in the layer 22 to act as a filler to cut down on the cost of the footwear.

It is also normally preferred to maintain a ⅛ to ¼ inch minimum thickness of the formable material 22 under the ball of the foot for absorption of shock.

Figure 8:
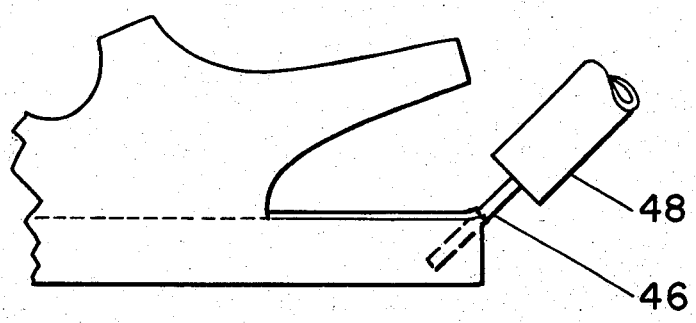
FIG. 8 is a fragmentary side elevation view showing how the formable material used in the casting unit can be injected in the casting unit after the article of footwear has been made and just prior to the sale of the footwear to a particular customer.

The present invention permits the matching of the amount of formable material 22 to the individual foot to accommodate differences in the heights of the arches and in the amount of heel and toe confinement desired. As illustrated in FIG. 8, the article of footwear can be formed with a suitable opening for receiving a tip 46 of a tube or gun 48 for injecting the formable material into the casting unit 20 just prior to the sale of the footwear to a customer. This not only permits matching the amount of material injected to the needs and desires of the particular customer, it also permits the customer to try on the article of footwear for overall size and appearance before the formable material 22 is placed into the casting unit 20.

Figure 2:
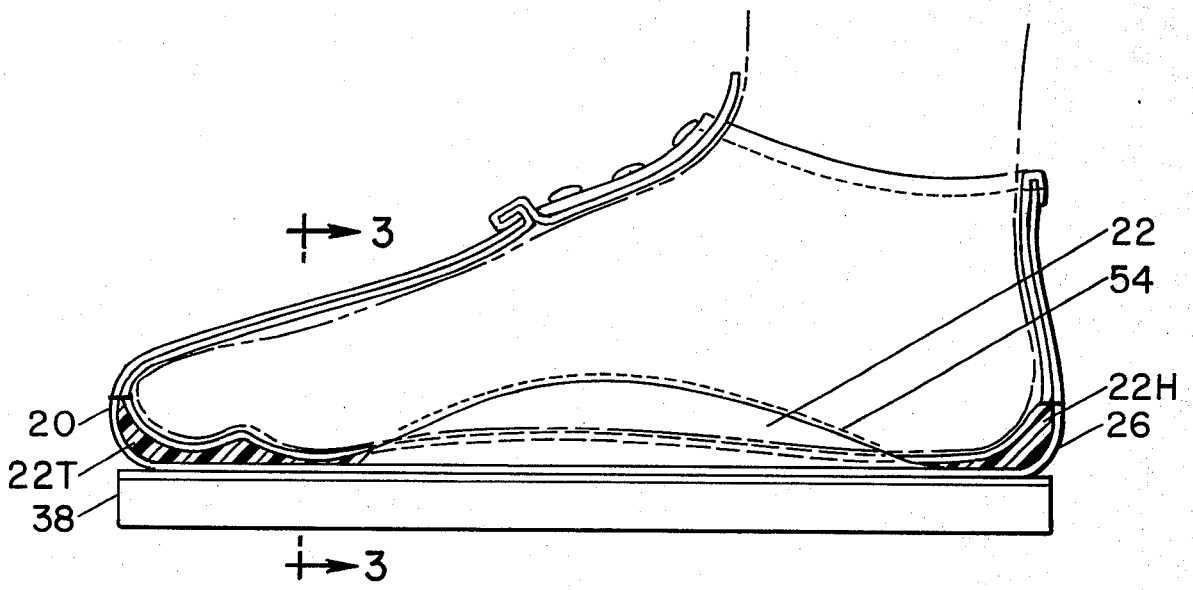
FIG. 2 is a side elevation view, partly broken away and in cross section to show details of construction, of a shoe embodying the casting unit of FIG. 1.
Figure 3:
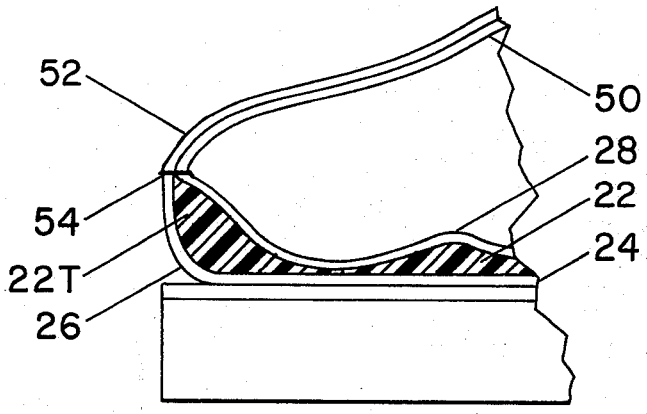
FIG. 3 is a fragmentary and elevation view taken generally along the line and in the direction indicated by the arrows 3 — 3 in FIG. 2.

As illustrated in FIGS. 2 and 3, the casting unit 20 can readily be incorporated in articles of footwear such as shoes and boots. In this case the inner sole 28 is connected to the liner 50 of the shoe upper 52 by a nonseam-forming connection such as a furriers stitch 54. As also illustrated in FIG. 3, the casting unit 20 is also preferably connected to the shoe upper by adhesive at least along the upper peripheral edge of the casting unit. This adhesive type of connection serves to limit the extent to which the material 22 can be moved upward during the shaping step. As illustrated in FIG. 2 this adhesive connection 54 follows generally the foot configuration to accommodate an increased amount of upward movement of the formable material 22 in the instep or plantar arch part of the foot.

In other embodiments of the invention a nonsetting formable material 22 has been incorporated in the casting unit 20. In this event, the formable material permits some reshaping after the initial shaping step but is viscous enough to provide a stabilized positioning of the foot within the footwear during normal use of the footwear. One particular material that has been found satisfactory for this type of application is General Electric Co. product RTV 619.

While I have illustrated and described the preferred embodiments of my invention, it is to be understood that these are capable of variation and modification, and I therefore do not wish to be limited to the precise details set forth, but desire to avail myself of such changes and alterations as fall within the purview of the following claims.

I claim:

1. An article of footwear having a customized, formfitted, casting unit for engagement with and support of the undersurface of a person's foot, said casting unit comprising a layer of a formable material having an undersurface on the sole side of the footwear and having an upper surface custom shaped to the contour of the foot, said formable material having sufficient pliability, prior to any curing of the formable material, so as to be displaceable to the exact contour of the underside of the person's foot by the application of the person's weight alone to the top of the casting unit without the necessity of any additional forming means, said casting unit including container means enveloping the formable material for totally enclosing the casting unit to seal off the formable material from the rest of the footwear and for preventing contact of the formable material with the person's foot, said container means including an innersole between the formable material and the person's foot, means for incorporating the casting unit in the article of footwear as an integral part of the footwear, and wherein the formable material is a moldable material and includes a curing agent and the casting unit is cured in the shaped configuration to a permanent molded state, and including edge restraint means for causing the formable material to turn upward along the periphery of the foot to provide positive foot-to-ground response and to prevent rotation and slippage of the footwear from the foot and wherein said layer of the formable material has sufficient initial thickness prior to custom shaping, to provide, after custom shaping, both side-cupped retainment of the foot and also heel and toe containment while maintaining a ⅛ to ¼ inch minimum thickness of the formable material under the ball of the foot for the absorption of shock.

2. An article of footwear having a customized, formfitted, casting unit for engagement with and support of the undersurface of a person's foot, said casting unit comprising a layer of a formable material having an undersurface on the sole side of the footwear and having an upper surface custom shaped to the contour of the foot said formable material having sufficient pliability, prior to any curing of the formable material, so as to be displaceable to the exact contour of the underside of the person's foot by the application of the person's weight alone to the top of the casting unit without the necessity of any additional forming means, said casting unit including container means enveloping the formable material for totally enclosing the casting unit to seal off the formable material from the rest of the footwear and for preventing contact of the formable material with the person's foot, said container means including an innersole between the formable material and the person's foot, and means for incorporating the casting unit in the article of footwear as an integral part of the footwear, and wherein the container means include said innersole and wherein said innersole is attached to the footwear along the periphery of the innersole to limit the upward movement of the formable material as the person's weight is placed on said upper surface of the casting unit.

* * * * *